United States Patent [19]

Adams, Jr. et al.

[11] 4,377,047

[45] Mar. 22, 1983

[54] IDENTIFICATION BRACELET

[75] Inventors: William E. Adams, Jr.; James J. Carroll, both of Philadelphia, Pa.

[73] Assignee: Medical I-D, Inc., Bala Cynwyd, Pa.

[21] Appl. No.: 229,962

[22] Filed: Jan. 30, 1981

[51] Int. Cl.[3] ..... G09F 3/14

[52] U.S. Cl. ..... 40/21 C; 40/586; 40/316

[58] Field of Search ..... 224/219, 222; 40/21 R, 40/21 C, 10 D, 316, 21, 586

[56] References Cited

U.S. PATENT DOCUMENTS

| | | | |
|---|---|---|---|
| 1,051,458 | 1/1913 | Sherman | 40/21 R |
| 1,202,589 | 10/1916 | Roosman | 40/10 D X |
| 1,657,250 | 1/1928 | Fetters | 40/21 R |
| 1,882,475 | 10/1932 | Blinckham | 40/21 C |
| 2,073,280 | 3/1937 | Lederer | 40/21 C |
| 2,749,634 | 6/1956 | Bellet et al. | 40/21 C |
| 2,835,993 | 5/1958 | Whitehead | 40/2.2 |
| 2,846,796 | 8/1958 | Polzin | 40/21 C |
| 2,893,143 | 7/1959 | Moshwr et al. | 40/21 C |
| 3,020,657 | 2/1962 | Clark | 40/21 C |
| 3,059,359 | 10/1962 | Goldammer | 40/21 C |
| 3,279,107 | 10/1966 | Baungartner | 40/21 C |
| 3,330,057 | 7/1967 | Rodgers | 40/21 C |
| 3,457,661 | 7/1969 | Peters | 40/2.2 |
| 3,656,247 | 4/1972 | Bushnell | 40/21 C |
| 3,751,835 | 8/1973 | Smith | 40/21 C |
| 3,800,450 | 4/1974 | Laugherty | 40/21 C |
| 3,805,427 | 4/1974 | Epstein | 40/21 X |
| 3,864,856 | 2/1975 | McNanus | 40/21 C |
| 3,877,162 | 4/1975 | Wilson | 40/10 D |
| 3,889,411 | 6/1975 | Adams et al. | 40/21 C |
| 3,965,589 | 6/1976 | McDermott | 40/21 C |
| 4,078,324 | 3/1978 | Wiebe | 40/21 C |

FOREIGN PATENT DOCUMENTS

| | | | |
|---|---|---|---|
| 23678 | 10/1912 | United Kingdom | 40/21 C |

*Primary Examiner*—Gene Mancene
*Assistant Examiner*—Wenceslao J. Contreras
*Attorney, Agent, or Firm*—Robert C. Podwil

[57] ABSTRACT

An identification bracelet has a band portion and an enclosure for a likeness of the wearer having an outwardly facing transparent portion, and a closure member adapted for snap closing of the enclosure. A second enclosure is provided for other identifying indicia. The enclosures and closure members are preferably integrally molded with the band portion.

9 Claims, 4 Drawing Figures

10
2
12
14
16
18
20
22
24
26
28
30
32
34
36
38
39
40
42
44
46
3
4

IDENTIFICATION BRACELET

BRIEF SUMMARY OF THE INVENTION

This invention relates to an identification bracelet, and more particularly, to a disposable hospital identification bracelet with which a photograph or other pictorial likeness the wearer may readily be associated.

In conventional modern-day hospital practice, when a patient is admitted, he or she is immediately provided with an identification bracelet which states the patient's name as well as other information, such as, typically, an identification number, attending physician's name, hospital service to which the patient is admitted, blood type and the like. Similar information is placed on a chart, which accompanies the patient if the patient is moved within the hospital.

In one presently used form of identification bracelet, the bracelet is a tubular band, into which a slip of paper or light cardboard, upon which the indicia is typewritten, may be inserted. Typically, in the use of such identification bracelets, after preparation of the information-bearing slip and insertion of it into the bracelet, the bracelet is sealed about the patient's wrist by swaging or deforming a metallic clasp. The band is removed only when the patient is discharged.

Notwithstanding nearly universal usage of some form of patient identification, it occasionally happens that medication is given to or procedures performed upon the wrong patient. Such errors, which obviously can have disastrous consequences, often occur when the patient is unconscious or otherwise unable to communicate, and it is necessary for an orderly, nurse or physician to check information on the identification bracelet against the patient's chart to be certain of identification.

The present invention is directed to a form of identification bracelet which is adapted to carry, in addition to the usual written or printed matter, a pictorial likeness of the patient. Thus, positive patient identification becomes a matter of little more than comparing the appearance of the patient with the likeness on the bracelet and, perhaps, an identical likeness affixed to the patient's chart.

Accordingly, it is an object of this invention to provide a novel identification bracelet, capable of carrying a pictorial likeness of the wearer. It is another object to provide a disposable hospital identification bracelet which is simple to manufacture and use. Other objects will appear hereinafter.

The foregoing and other objects of this invention are realized, in a presently preferred embodiment, by an identification bracelet in which a band portion is adapted to encircle a limb of a wearer to secure the bracelet to the limb; clasp means are associated with the band portion for securing the bracelet; and an enclosure, integrally formed with the band portion, has an outwardly facing transparent portion through which the likeness is visible. Thus, a likeness may be placed in the enclosure and seen through the transparent portion of the enclosure. A closure member is provided for the enclosure, preferably integrally molded with the band portion and hingedly attached to it, and the cover member is so positioned and arranged that it can fold beneath the band to cover the underside of the enclosure. Snap-engaging means associated with the cover member and enclosure also serve to secure the cover member in its enclosure-covering position.

For the purpose of illustrating the invention, there is shown in the drawings a form of the invention which is best mode presently contemplated, it being understood, however, that the invention is not limited to the precise arrangement and instrumentalities shown.

DETAILED DESCRIPTION

Figures 1, 2, 3, 4:
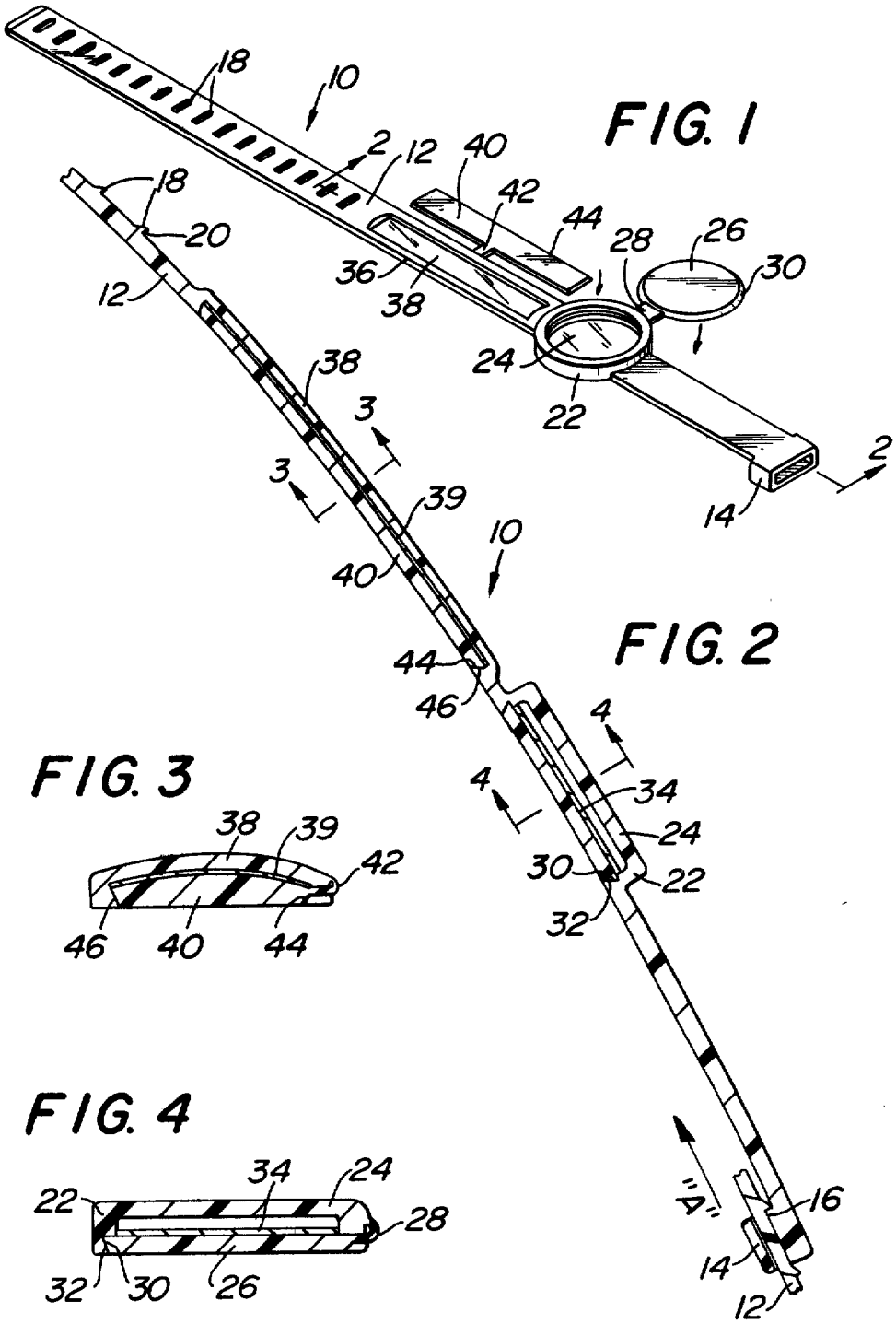
FIG. 1 is a perspective view of an identification bracelet in accordance with the present invention, in its initial, non-operative condition.
FIG. 2 is a cross-sectional view, taken along the line 2—2 in FIG. 1, but showing the invention in preparation for usage.
FIG. 3 is a cross-sectional view taken along the line 3—3 in FIG. 2.
FIG. 4 is a cross-sectional view taken along the line 4—4 in FIG. 2.

Referring now to the drawings in detail, wherein like reference numerals indicate like elements, there is seen in FIG. 1 an identification bracelet designated generally by the reference numeral 10.

The identification bracelet 10 comprises a band portion 12 adapted to circle a limb of a wearer to secure the bracelet 10 thereto. It will be appreciated that the bracelet 10 will ordinarily be placed around the wrist of a wearer, but it may, if necessary or desired, be applied elsewhere.

Clasp means are provided in association with the band portion 12 to facilitate closing of the band portion to form a continuous limb-encircling bracelet.

Referring now to FIGS. 1 and 2, the clasp means in the illustrated form of the invention comprises a guide portion 14 disposed adjacent one end of the band portion 12, an abutment 16 associted with the guide portion 14, and a series of ratchet members 18 associated with and disposed upon the other end of the band portion 12.

Referring now to FIG. 2, the manner in which the clasp means operates to secure the band portion 12 should now be apparent. The end of the band portion 12 which bears the ratchet members 18, it will be seen, may be threaded through the guide portion 14. The ratchet members 18 are so configured in profile that movement through the guide portion 14 in a band-tighting direction (indicated by the arrow "A" in FIG. 2) is facilitated. If, on the other hand, an effort is made to withdraw the end of the band portion 12 from the guide portion 14, a perpendicular surface 20 of a ratchet member 18 engages the abutment 16, and prevents loosening of the hand portion 12. Although it may be made removable if so desired for particular applications, it is preferable, and greatly to be desired in the usual case, that the identification bracelet 10 not be removable except by severing of the band portion 12.

Referring now to FIGS. 1 through 4, associated with the band portion 12 is an enclosure 22, which facilitates coupling to the band portion 12 of a pictorial likeness of the wearer. The enclosure 22 includes a transparent portion 24, which, when the bracelet 10 is operatively disposed, faces outwardly away from the limb of the wearer.

The underside of the enclosure 22 is open, but a closure member 26, associated with the band portion 12 and enclosure 22 in a manner which will be described below, serves to close and seal the underside of the enclosure 22 when the closure member 26 is operatively disposed.

Referring again to FIGS. 1 and 4, the closure member 26, in the illustrated form of the invention, is operatively associated with the enclosure 22 by means of a self-hinge 28, which enables the closure member 26 to rotate through an arc of approximately 180 degrees from its open, inoperative position illustrated in FIG. 1, to the operative position seen in cross-section in FIGS. 2 and 4.

Referring now to FIGS. 1, 2 and 4, the edges 30 of the closure member 26 in the illustrated embodiment are chamfered at an angle of approximately 30 degrees (30), and the chamfered edges 30 are associated, when the closure member 26 is operatively disposed, with a complimental chamfer 32 encircling the rear of the enclosure 22. The chamfered edges 30 and 32, it will be understood, provide a snap-engaging action, which causes the closure member 26 to securely and sealingly engage the rear of the enclosure 22 to close the enclosure 22. Closing of the closure member 26 serves to secure within the enclosure 22 a photograph 34 or other pictorial likeness of the wearer. The likeness, it will be appreciated, is oriented so that it can be viewed through the transparent portion 24 of the enclosure 22.

The orientation of the closure member 26 with respect to the limb of the wearer, when the bracelet 10 is operatively disposed, is such that the disposition of the rear of the closure member 26 with respect to the limb prevents the closure member 26 from inadvertently opening. Indeed, if the band portion 12 is suitably snug in its engagement with the limb of the wearer, opening of the enclosure 22 while the bracelet 10 is in position may be virtually impossible. The snap-engaging action of the closure member 26 and the enclosure 22 and the above mentioned disposition of the closure member 26 with respect to the limb of the wearer compliment each other, and together assure against inadvertent opening of the enclosure 22 and loss or removal of the photograph or other likeness.

Disposed within the band portion 12 of the identification bracelet 10 in a presently preferred embodiment is an elongated enclosure 36, which has a transparent portion 38 like the transparent portion 24 of the above-described enclosure 22. The enclosure 36 is adapted to receive and retain the usual and presently conventional written identifying indicia 39. The enclosure 36 is also provided with a closure member, designated by the reference numeral 40. The closure member 40 is coupled to the band portion 12 by a self-hinge 42, and like the closure member 26, the closure member 40 may be provided with chamfered edges 44 to compliment similarly chamfered edges 46 of the enclosure 36.

In its preferred embodiment, the identification bracelet 10 is molded in a single piece, perhaps most advantageously by injection molding techniques, from a clear material such as the tough, resilient semi-rigid and highly transparent polymer sold under the trademark "Surlyn" by E. I. du Pont de Nemours Co. Other suitable materials will occur to those skilled in the art. If desired, the surface texture of the bracelet 10 may be made rough so as to render the material translucent, except where transparency is desired, as at the transparent portions 24 and 38.

The present invention may be embodied in other specific forms without departing from its spirit or essential attributes, and, accordingly, reference should be made to the appended claims rather than the foregoing specification as indicating the scope of the invention.

We claim:

1. A disposable hospital identification bracelet comprising a band portion adapted to encircle a limb of a wearer to secure the bracelet thereto, clasp means associated with said band portion for securing said bracelet in a limb-encircling configuration, means associated with said band portion for coupling to said band portion a likeness of the wearer, and means associated with said band portion for securing to said band portion other identifying indicia relating to the wearer, said means for coupling to said band portion a likeness of the wearer comprising an enclosure having an outwardly facing transparent portion thereof through which the likeness is visible and an open underside thereof facing the limb of the wearer when the bracelet is operatively disposed, and a self-closure member for said enclosure, a self-hinge interconnecting said self-closure member and said enclosure, said self-hinge being so located with respect to said enclosure and said self-closure member as to permit said self-closure member to be rotated beneath the band portion to cover the underside of said enclosure when the bracelet is operatively disposed so that the limb of the wearer maintains said self-closure member in its operative disposition wherein it covers the underside of said enclosure, said band portion, said enclosure, said self-closure member and said self-hinge being integrally formed as a single piece of polymeric material.

2. An identification bracelet in accordance with claim 1, wherein said means for securing other identifying indicia to said band portion comprises a generally elongated second enclosure disposed in said band portion and having an outwardly facing transparent portion thereof and an open underside thereof which faces the limb of the wearer when the bracelet is operatively disposed, and a self-closure member for said second enclosure, a self-hinge interconnecting said self-closure member and said second enclosure, said self-hinge being so located with respect to said second enclosure and said self-closure member for said second enclosure to enable said self-closure member to be rotated to cover the underside of said second enclosure when the bracelet is operatively disposed so that the limb of the wearer maintains said closure member in its operative disposition, said self-closure member for said second enclosure and said self-hinge therefore being integral with the remainder of said identification bracelet.

3. Apparatus in accordance with claim 2, and snap-engageable means for maintaining said self-closure members in their operative dispositions.

4. Apparatus in accordance with claim 2, and snap-engageable means associted with said enclosures and said self-closure members for maintaining said self-closure members in their operative dispositions.

5. Apparatus in accordance with claim 4, wherein said snap-engageable means comprises chamfered circumferential edges on said self-closure members, and complimental chamfered edges disposed about the peripheries of said enclosures.

6. Apparatus in accordance with claim 2, wherein said clasp means comprises a guide portion disposed adjacent one end of said band portion, an abutment associated with said guide portion, and a series of ratchet members disposed adjacent the other end of said band and adapted to cooperatively engage said abutment to secure said bracelet.

7. An identification bracelet, comprising a band portion adapted to encircle a limb of a wearer to secure the bracelet thereto, clasp means associated with said band portion for securing said bracelet in a limb-encircling configuration, and means associated with said band for coupling to said band portion a likeness of the wearer, said means for coupling to said band portion a likeness of the wearer comprising an enclosure integrally molded with said band portion and having an outwardly facing transparent portion thereof through which the likeness is visible, a self-closure member for said enclosure integrally molded with said band portion and hingedly coupled thereto, said self-closure member being so positioned and arranged as to cover the underside of said enclosure when said self-closure member is operatively disposed, so that the limb of the wearer tends to maintain said closure member in its operative disposition.

8. Apparatus in accordance with claim 7, and snap-engageable means on said enclosure and said self-closure member for maintaining said self-closure member in its operative disposition.

9. Apparatus in accordance with claim 8, wherein said snap-engageable means comprises chamfered circumferential edges of said self-closure members, and complimental chamfered edges disposed about the peripheries of said enclosures.

* * * * *